United States Patent [19]

Alliquander et al.

[11] 4,397,619

[45] Aug. 9, 1983

[54] HYDRAULIC DRILLING MOTOR WITH ROTARY INTERNALLY AND EXTERNALLY THREADED MEMBERS

[75] Inventors: Ödön Alliquander; Lajos Nàtkai; Elek Ujfalusi, all of Budapest, Hungary

[73] Assignee: Országos Köolaj és Gázipari Tröszt, Budapest, Hungary

[21] Appl. No.: 130,563

[22] Filed: Mar. 14, 1980

[30] Foreign Application Priority Data

Mar. 14, 1979 [HU] Hungary ..... OA 619

[51] Int. Cl.[3] ..... F03C 2/22; E21B 4/02

[52] U.S. Cl. ..... 418/48; 418/166; 175/107

[58] Field of Search ..... 418/48, 166, 201; 175/107

[56] References Cited

U.S. PATENT DOCUMENTS

| | | | |
|---|---|---|---|
| Re. 21,374 | 2/1940 | Moineau | 418/48 |
| 1,892,217 | 12/1932 | Moineau | 418/48 |
| 3,299,822 | 1/1967 | Payne | 418/48 |
| 3,840,080 | 10/1974 | Berryman | 175/107 |
| 4,221,552 | 9/1980 | Clark | 418/48 |

FOREIGN PATENT DOCUMENTS

| | | | |
|---|---|---|---|
| 85331 | 1/1936 | Sweden | 418/48 |
| 427475 | 4/1935 | United Kingdom | 418/48 |

*Primary Examiner*—John J. Vrablik

*Attorney, Agent, or Firm*—Gabriel P. Katona

[57] ABSTRACT

There is disclosed an hydraulic drilling motor for well drilling. The motor is of the push-down axial flow type. It is of vibration-free rotary chamber-type construction functioning with high torque wherein the r.p.m. and capacity of the drilling tool are in proportion with the velocity and pressure of the flowing medium. The motor consists of an internally threaded chamber with an arch parallel with the flow direction of an externally threaded spindle of $z_o = z_k$ (arch or thread)+1, or $z_o = z_k - 1$ thread, of identical course with the chamber, arranged in the chamber. The cross section of the spindle or chamber is prolate, peaked or curate cycloid. When the spindle is cycloid cross sectional, the cross section of the chamber is in the same plane, and when the chamber is in cycloid cross sectional the cross section of the spindle is in the same plane. This is limited by the external or internal envelope curve of the surface touched by the cycloid during relative motion.

1 Claim, 4 Drawing Figures

HYDRAULIC DRILLING MOTOR WITH ROTARY INTERNALLY AND EXTERNALLY THREADED MEMBERS

BACKGROUND

The invention relates to a push-down hydraulic well drilling motor with axial flow. The attached drill is rotated by the motor through torque generated by the energy of the flowing flush water.

The rotary-swivel heads and so-called push-down drilling motors used for the drilling of hydrocarbon wells are generally known equipment.

The drilling turbine is regarded as conventional equipment, the r.p.m., torque and efficiency—as in any machine functioning on the fluid mechanical principle—depend on the flow of liquid and load.

A drawback of the drilling turbine is that overloads cause it to stop, it is sensitive to impurities in the water and has a relatively short life-span. Also putting the unit into service and starting it are complicated.

In the electrical push-down drilling motors the insulation deteriorates due to the heat and pressure conditions prevailing in the bore hole causing difficulties. The appropriate r.p.m. can be ensured generally only with gear transmission. Use of the electric push-down drilling motor is inhibited, or limited also by the cable connection. Another known drilling motor is the holing-type which functions on the principle of volumetric displacement. It consists of an internally threaded stator of multiple arch section (multiplex thread) and an externally threaded rotor, in which the thread number is different from that of the stator.

All of these generally known push-down hydraulic drilling motors have a problem caused by the placement of the shaft of the rotor in the center of gravity not in the centerline of the jacket. The centerline (median) of the rotor thus moves in a circular orbit around the centerline of the jacket and stator. Consequently the rotary motion of the rotor only can be transmitted to the drill, or to the transmitting driving shaft through the propeller shaft. The propeller shaft is at an angle to the rotor or driving shaft, thus the radial component-due to the obliquity of the propeller shaft-of the reaction force arising from the hydraulic pressure and acting on the rotor, increases the friction between the stator and rotor, thereby considerably reducing the efficiency and life-span of the drilling motor. The propeller mechanism can be built into the drilling motor of fixed length only at the expense of the useful motor-part producing the torque. The useful cross section for transmitting the energy carrier medium for the torque can be only a small proportion of the cross section of the device. Due to the excentricity of the median of the rotor, significant mass forces arise at higher r.p.m., deterimentally loading the stator and rotor surfaces, causing vibration and leading to breakage due to fatigue of the drill pipe. The increased friction force reduces also the torque utilizable for drilling.

In addition to well known drilling motors which attempt to overcome the problems mentioned, there is also a unit in which the rotor (spindle) suitable for rotation of the drilling tool revolves around the shaft in its center of gravity eliminating vibration, yet it is not centered with the jacket. Gears are used to synchronize, or transmit the rotary motions, however, because of space requirements these devices are unsuitable for drilling. Thus, there is still a need for a drill in which there is transmission of the rotation of the rotary stator, the so-called rotary chamber member, or spindle into the centerline of the external jacket and maintenance of the flush flow necessary even in case of jamming.

SUMMARY

An object of this invention is to provide a push-down drilling motor which increases the efficiency, economy and capacity of the drilling, especially those of the well driling associated with the known equipment. Another object of this invention is to provide drilling equipment having simplified mounting, running, handling and increased efficiency in the whole operation range.

An advantage of the invention is provision *7a* drilling motor using the volumetric principle to achieve an efficient, vibration-free rotary chamber-type construction functioning with high torque. This is due to the statical and dynamic balance of the rotary parts in which the r.p.m. and capacity of the drilling tool is in proportion with the velocity and pressure of the flowing medium. Hence the driving motor according to the invention is economically applicable for use in the drilling of oil wells. It is particularly effectively utilizable for directional well drilling of great depth, since with the use of the drilling motor according to the invention the drilling tool working in the straight deep, or if necessary in the reversed bore hole, can be operated at a minimum loss of energy and with high torque.

The equipment according to the invention consists of an internally threaded chamber member of $z_k$ arc ($z_k$ thread), parallel with the flow direction and of an externally threaded spindle of $z_o=z_k+1$, or $z_o=z_k-1$ thread, of identical course with the chamber member, arranged within the chamber member. The cross section of the spindle or chamber member is prolate, peaked or curtate cycloid. In the case of the cycloid cross sectional spindle the cross section of the chamber member in the same plane, and in case of cycloid cross sectional chamber member the cross section of the spindle in the same plane are limited by the external or internal envelope curve of the surface touched by the cycloid during the relative motion described hereinafter. The shaft of the spindle is parallel with that of the chamber member, at a distance "e" from the chamber member. In the rotary chamber construction of the drilling motor according to the invention, in order to avoid the mass forces and vibration, the spindle shaft is constantly centered with the cylindrical, external jacket. Pitch $h_o$ of the spindle is $z_o/z_k$ multiplied by the pitch of chamber member $h_k$. Any of the spindles cross sections are connected free of or with minimal clearance to the cross section of the chamber member in the same plane, and they divide the inner section of the chamber member to surface-parts varying, i.e. constantly increasing and constantly decreasing, along the centerline as a result of the varying pitch, whereby closed hollow parts of identical length and shape remain between the threads of the chamber member and spindle for the medium which is generally either flush water or gas, which actuates the equipment. These hollow parts intertwined along the centerline but delimited continuously from each other are repeated at constant distance of $1=h_k/z_k=h_o/z_o$ in identical phase; the inlet side is separated at least once from the outlet side, thereby preventing the medium from flowing through without working in the stationary position of the equipment, e.g. in case of jamming.

In the rotary chamber member type construction of the equipment according to the invention the chamber member rotates with a revolution $n_k$, while the spindle with $n_o=(z_k/z_o)\ n_k$ in accordance with the quantity of the admitted medium and with the forced coupling or modification of the profiles at the expense of the pressure force of the medium flowing during operation. Meanwhile the volume element carrying the medium advances in axial direction toward the outlet side of lower pressure at a rate of $v=n_k h_s=n_o h_o$ without change of shape and volume and free of turbulent motion.

In the stationary chamber member type construction of the equipment according to the invention only the spindle moves to the pressure of the flowing medium guided by the internal thread of the stationary chamber member. Movement of the spindle in relation to the chamber member corresponds to the relative movement of the spindle of the rotary chamber member construction, but here, due to the fixed position of the chamber member, the spindle is forced to a planetary motion, thus, it revolves around its own shaft while it circulates around the shaft of the chamber member and jacket. In this case, the volumetric elements formed between the chamber member and spindle threads advance in rotary motion toward the outlet side.

The rotary chamber member construction of the equipment according to the invention has no oscillating part. As a result of the symmetrical sections, the multiplex-threaded chamber member and spindle revolve around the shaft in their own centre of gravity, while the single, thread chamber member and spindle, particularly in case of high r.p.m.—can be statically and dynamically balanced by the appropriate arrangement of lightening holes.

BRIEF DESCRIPTION OF THE DRAWINGS

Examples of the equipment according to the invention are illustrated by the diagrams as follows.

DETAILED DESCRIPTION

Figure 1:
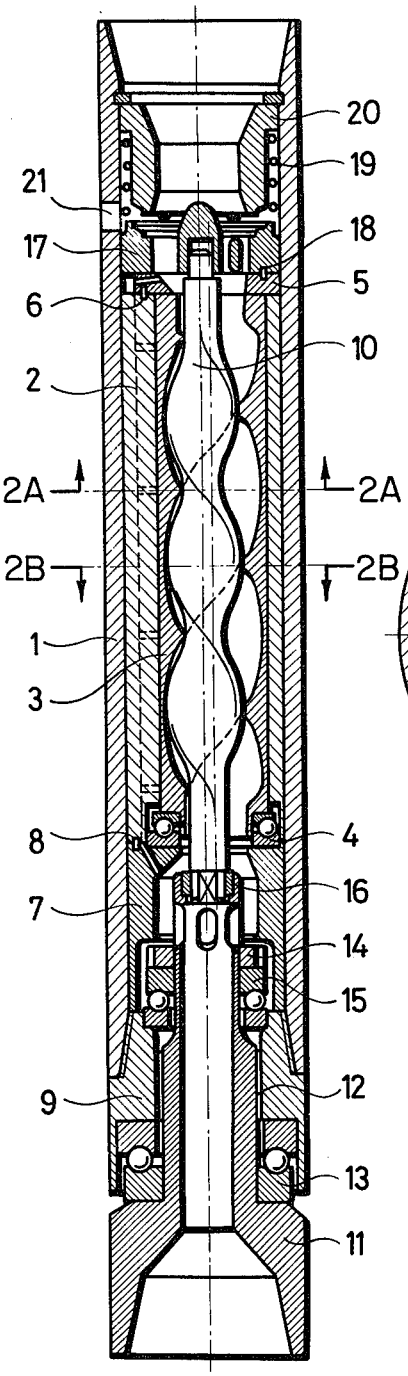
FIG. 1: Rotary chamber member construction of the equipment with single threaded (single arc epicycloid section), rotary chamber member and double, threaded, (elliptical section), screw spindle in longitudinal section.
Figure 2:
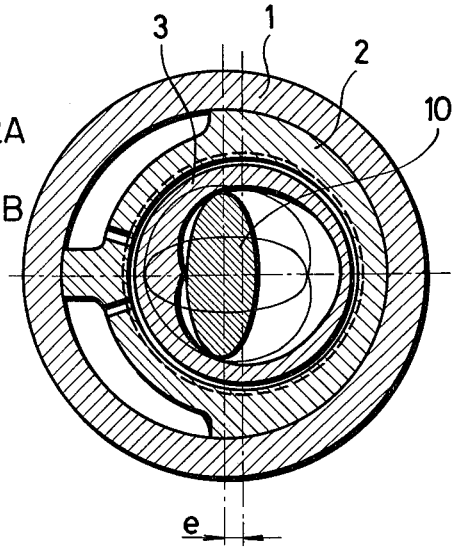
FIG. 2: Cross section 2A—2A as shown in FIG. 1., with section 2B—2B drawn in thin line.

The equipment according to the invention shown in FIG. 1 illustrates an example of the embodiment which can be used to advantage even under extreme operating conditions. The excentric bush 2 solidly fitting in the jacket 1 provided with tapered thread at both ends, forms the single-start internally threaded radial bearing developed as a rotary chamber member 3. The eccentric bush 2, in the interest of centering the median and ensuring the by-pass flow of the medium, is provided with lightening holes and for its lubrication with spiral grooves and radial holes on the internal surface. The rotary chamber member 3 is surrounded by the thrust bearing 4 and transition 5 in axial direction. Transition 5 is provided with a hole or holes leading into the by-pass ducts of the eccentric bush 2; its angular position is ensured by dowel pin 6. The thrust bearing 4 is centered by the eccentric bearing housing on the upper plane of distance piece 7 mounted with transient fitting into the jacket 1, while the suitable direction of the eccentricity is ensured with dowel pin 8. The asymmetrical internal cavity of the distance piece 7 for guiding through the working medium is connected by hole(s) with the by-pass ducts of the eccentric bush 2. Purpose of the by-pass line system consisting of the hole(s) in transition 5 and in the by-pass ducts of the eccentric bush 2, and of the hole(s) leading into the internal cavity of the distance piece 7, is to maintain a reduced flushing flow when the drilling tool is jammed. The axial force arising from the hydraulic pressure during operation and acting on chamber member 3 is transmitted through thrust bearing 4 and distance piece 7 onto the upper plane of the bearing housing 9 connected to the lower tapered-threaded end of the jacket 1. The driving shaft 11 transmitting the rotation of the double-threaded spindle 10 toward the driving tool is carried in bearing housing 9, said driving shaft being supported radially by bush 12 pressed into the bearing housing 9, and axially by the thrust bearing 13 and thrust bearing 15 fixed with the bearing nut 14. Weight of the spindle 10 and the force from the hydraulic pressure acting on the spindle during operation to build up the load on the thrust bearing 15 through coupling 16, driving shaft 11 and bearing nut 14, while the axial load of the drilling tool is transmitted by thrust bearing 13 through the driving shaft 11. The flushing medium passes from the asymmetrical cavity of the distance piece 7 through the opening(s) formed on the jacket of the driving shaft 11 and through the axial central hole of the nozzles of the drilling tool, and to the holing. The upper pivot of the spindle 10 is carried in the spindle bearing 17 mounted into the jacket 1 with transient fitting, the external ring of which fitting to jacket 1 and the hub-part forming the spindle bearing 17 are connected with streamlined spokes. The valve 20 held in upper position by the coil spring 19, as a result of the pressure difference, passes into lower position against the spring force during operation, and shuts off the annular space leading to the radial holes formed on jacket 1. After cessation of the flow of medium, the valve 20 rises to upper position and the flushing medium can freely flow through filters 21 and through the holes of the ring of spindle bearing 17. This way the valve 20 ensures the overpressure necessary for rotation of the spindle during operation, filling up the equipment at installation, and flow of the flushing medium from the drill pipe into the hole when the drilling pipes are retrieved.

Figure 3:
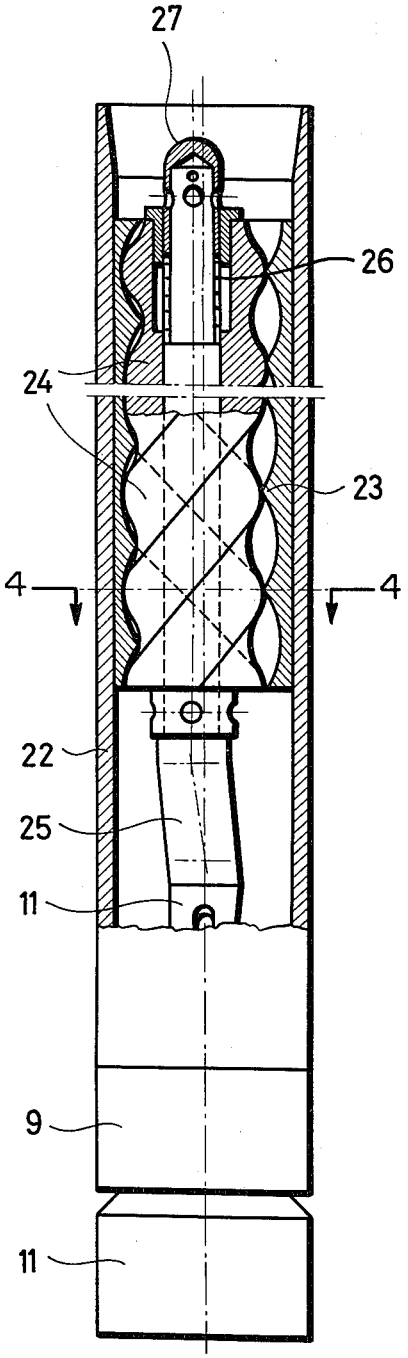
FIG. 3: Stationary chamber member type construction of the equipment with triple-threaded (triple arc epicycloid section) chamber member and four-start (four arc epicycloid section) threaded chamber member and four-start (four arc hypocycloid section) screw spindle in longitudinal section.
Figure 4:
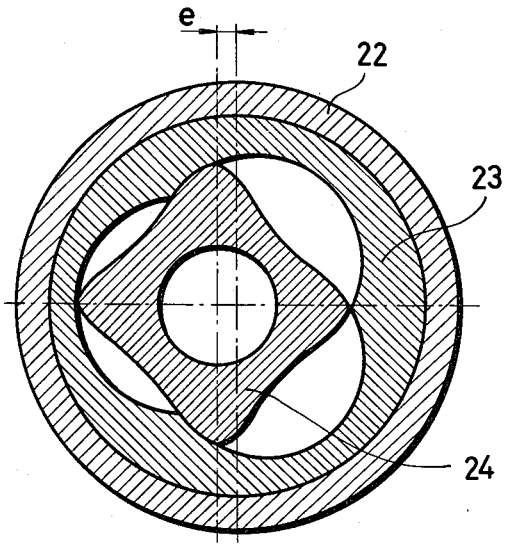
FIG. 4: Cross section 4—4 as shown in FIG. 3.

FIG. 3 illustrates a stationary chamber member-type construction of the equipment according to the invention, giving high torsional moment at low r.p.m. Cross section of the internally threaded chamber member 23 developed as a stationary chamber member fixed with solid fitting into the jacket 22 is a triple-arc epicycloid, while the four-arc hypocycloid section of the externally threaded spindle 24 fitting to the threaded surface of the chamber member is surrounded by the inner envelope curve of the surface touch by the chamber member section during the relative movement on the identical plane of chamber member 23. The torsional moment arising from the hydraulic pressure and the axial force are transmitted to the drilling tool by the propeller shaft 25 provided with an elastometric sleeve-pipe through the driving shaft 11 revolving in bearing housing 9. In this construction the by-pass flow of the flush water is ensured through the central hole of spindle 24 by valve 27 sustained with coil spring 26, which valve passes into lower position during operation to the effect of the pressure difference and against the spring force; the large cross sectional radial transfer hole(s) of the valve body is (are) closed and only the narrow cross sectional upper radial hole(s) of the valve body will remain in open position, for the purpose of maintaining reduced flow of the flush water in case of jamming. The by-pass flow of the flushing medium exits through the radial hole(s) on the lower stub of spindle 24, and passes under the propeller shaft 25 and through the hole(s) formed on the jacket of the driving shaft 11 and through the axial central hole to the nozzles of the drilling tool and to the holing.

The advantages of the hydraulic drilling motor according to the invention are that it fulfils completely the requirements of the most advanced rotary-drilling technology by being a push-down drilling motor running with high torque, efficiently, free of vibration, on the principle of volumetric displacement, using the energy of the flushing medium, and having long life-span. The propeller shaft used at the conventional push-down drilling motors functioning on the principle of volumetric displacement, is not necessary, since here the spindle and the tool are uniaxial. In case of jamming, a reduced flushing flow is automatically ensured in order to prevent the cuttings from settling back and the tool from jamming. The space confining elements close accurately and without overlapping, their geometry is precisely specified, hence the loss due to friction is minimal. The drilling motor is not sensitive to impurities, on the contrary it is self-cleaning; small impure particles pass through the motor-part without trouble. Starting and running of the drilling motor are simple, it is favourably used for straight and directional well drillings.

What we claim is:

1. A hydraulic drilling motor with an external jacket and a driving shaft, for oil and water well drilling with axial flow, consisting of an internally threaded rotary chamber member seated on a thrust bearing of said motor, wherein (a) the rotary axis of said chamber member is parallel to the direction of flow;

(b) a rotary externally double-threaded screw spindle having an elliptical cross-section is eccentrically arranged in said chamber member and is centrally arranged in relation to said external jacket and is rigidly fixed to said driving shaft; and (c) the internal surface of said chamber member is a single arc epicycloid spiral surface.

* * * * *